US007027744B2

(12) United States Patent
Simpson et al.

(10) Patent No.: US 7,027,744 B2
(45) Date of Patent: Apr. 11, 2006

(54) TONER CARTRIDGE WITH INTEGRAL MICR FONT, AND METHODS

(75) Inventors: Shell S. Simpson, Boise, ID (US); Darrel D. Cherry, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 98 days.

(21) Appl. No.: 10/699,291

(22) Filed: Oct. 30, 2003

(65) Prior Publication Data

US 2005/0095016 A1 May 5, 2005

(51) Int. Cl.
*G03G 15/00* (2006.01)

(52) U.S. Cl. ..... 399/12

(58) Field of Classification Search ..... 399/12, 399/25, 27, 111, 119, 262
See application file for complete search history.

(56) References Cited

U.S. PATENT DOCUMENTS 5,347,302 A * 9/1994 Simonoff ..... 347/139
5,634,169 A * 5/1997 Barry et al. ..... 399/12
6,011,935 A * 1/2000 Matsuzaka et al. ..... 399/12
6,236,816 B1 * 5/2001 Warbus et al. ..... 399/46
2003/0227501 A1 * 12/2003 Hatasa et al. ..... 347/19

FOREIGN PATENT DOCUMENTS

EP 1429195 A2 * 6/2004
JP 2003341149 A * 12/2003

* cited by examiner

*Primary Examiner*—Robert Beatty
(74) *Attorney, Agent, or Firm*—Larry Baker

(57) ABSTRACT

Embodiments of the invention include a toner cartridge for the printing of MICR characters that includes a memory device that is programmed with the requisite font for MICR characters. The font is accessible for the printing of MICR characters when the toner cartridge is installed in a printer. In a further embodiment, the memory device on the toner cartridge may also contain a data flag indicating that a print job must print at least one symbol in the MICR font. Corresponding printer firmware may then determine if this flag is present, and, if present, will prevent the printing of print jobs that do not include at least one character to be printed in the MICR font. This prevents MICR toner from being wasted on documents that do not require MICR toner, such as normal office correspondence.

17 Claims, 5 Drawing Sheets

TONER CARTRIDGE WITH INTEGRAL MICR FONT, AND METHODS

TECHNICAL FIELD OF THE INVENTION

The present invention relates generally to printing systems, and more specifically to printer consumables for printing Magnetic Ink Character Recognition (MICR) characters, and methods.

BACKGROUND OF THE INVENTION

Magnetic Ink Character Recognition (MICR) is a system developed to allow the mechanical processing of checks by financial institutions. A "bank line" of magnetically readable characters is written near the bottom of each check, consistent with American National Standards Institute (ANSI) and American Banking Association (ABA) standards that define the content, placement, and readability of the line. The line includes account information and other data, such as dollar amount. Magnetic sensors in check processing equipment detect and decode the MICR line of characters as checks are scanned past the sensors. While optical character recognition (OCR) is increasingly replacing magnetic sensors, there remains a need to maintain compatibility with older processing systems.

One process commonly used for printing MICR characters is the use of a laser printer with a specialized MICR toner. MICR toner differs from standard laser printer toner by the inclusion of a 50% to 60% iron oxide additive content. Because the toner must meet special requirements beyond human readability, and also because of the lower demand, MICR toner cartridges are substantially more expensive than standard toner cartridges.

MICR characters are also printed in a special font which facilitates accurate character recognition by magnetic sensors. The required character font may typically be provided by a memory module installed in the printer, or through software. Typically, fonts are stored in a file format that allows the printer (or computer) to accurately reconstruct the characters and symbols; font files may, for example, be stored in raster, vector, and TrueType formats, which differ in the manner in which the "glyphs" for each character or symbol is stored.

In many office environments a standard laser printer is used to print both checks and other non-check documents. In these environments, it is not uncommon for office workers to inadvertently use the more expensive MICR toner to print ordinary office documents, or to use non-MICR toner to print checks. Importantly, checks printed using non-MICR toner do not look any different than checks printed with MICR toner, and a seemingly valid check could thus be printed using non-MICR toner. This can lead to difficulties in processing the check, which can both embarrass the party cashing the check and make the company issuing the check appear less professional.

Offices may typically adopt one or more approaches to avoid both wasting expensive MICR toner and check-printing errors. One approach is the use of pre-printed check forms, which include a partial MICR bank line with account information, thus entirely avoiding the need for the office to use MICR toner. This approach has several drawbacks. First, the pre-printed checks must be loaded into the printer before a check printing session and unloaded afterwards, and it is thus not uncommon for non-check documents to be inadvertently printed on the pre-printed forms. Second, it is possible to run out of the pre-printed forms, which stops additional checks from being issued until more check forms are obtained. Third, the preprinted information on the forms must properly line up with the information being printed on the check, and it is possible to misalign the printed output on the check media, leading to the payee, amount, etc. being printed in the wrong location on the check. Finally, the preprinted forms present security issues, in that the preprinted forms can be stolen and checks can be forged.

A second approach is to have office workers carefully install the MICR toner cartridge before printing checks and remove it when done. Needless to say, being careful doesn't always work. Checks can be inadvertently printed with non-MICR toner, and non-check documents can be inadvertently printed using MICR toner.

There is therefore a need for apparatus and methods that prevent the inadvertent printing of checks with non-MICR toner, and the printing of non-check documents with MICR toner.

SUMMARY OF THE INVENTION

An exemplary embodiment of the invention comprises a toner cartridge for the printing of MICR characters that includes a memory device that is programmed with the requisite font for MICR characters. The font is accessible for the printing of MICR characters when the MICR toner cartridge is installed in a printer.

In a further embodiment, the memory device on the toner cartridge may also contain a data flag indicating the cartridge contains MICR toner. Printer firmware, or computer software, may then determine if this flag is set, and, if set, inhibit the printing of print jobs that do not require MICR toner, such as, for example, those jobs that do not include at least one character to be printed in the MICR font. The flag may thus be utilized to prevent MICR toner from being wasted on documents that do not require MICR toner.

Other aspects and advantages of the present invention will become apparent from the following detailed description, taken in conjunction with the accompanying drawings, illustrating by way of example the principles of the invention.

BRIEF DESCRIPTION OF THE DRAWINGS

These and other features and advantages of the present invention will become more apparent from the following detailed description of exemplary embodiments thereof, as illustrated in the accompanying drawings, in which.

DESCRIPTION OF EXEMPLARY EMBODIMENTS

Figure 1:
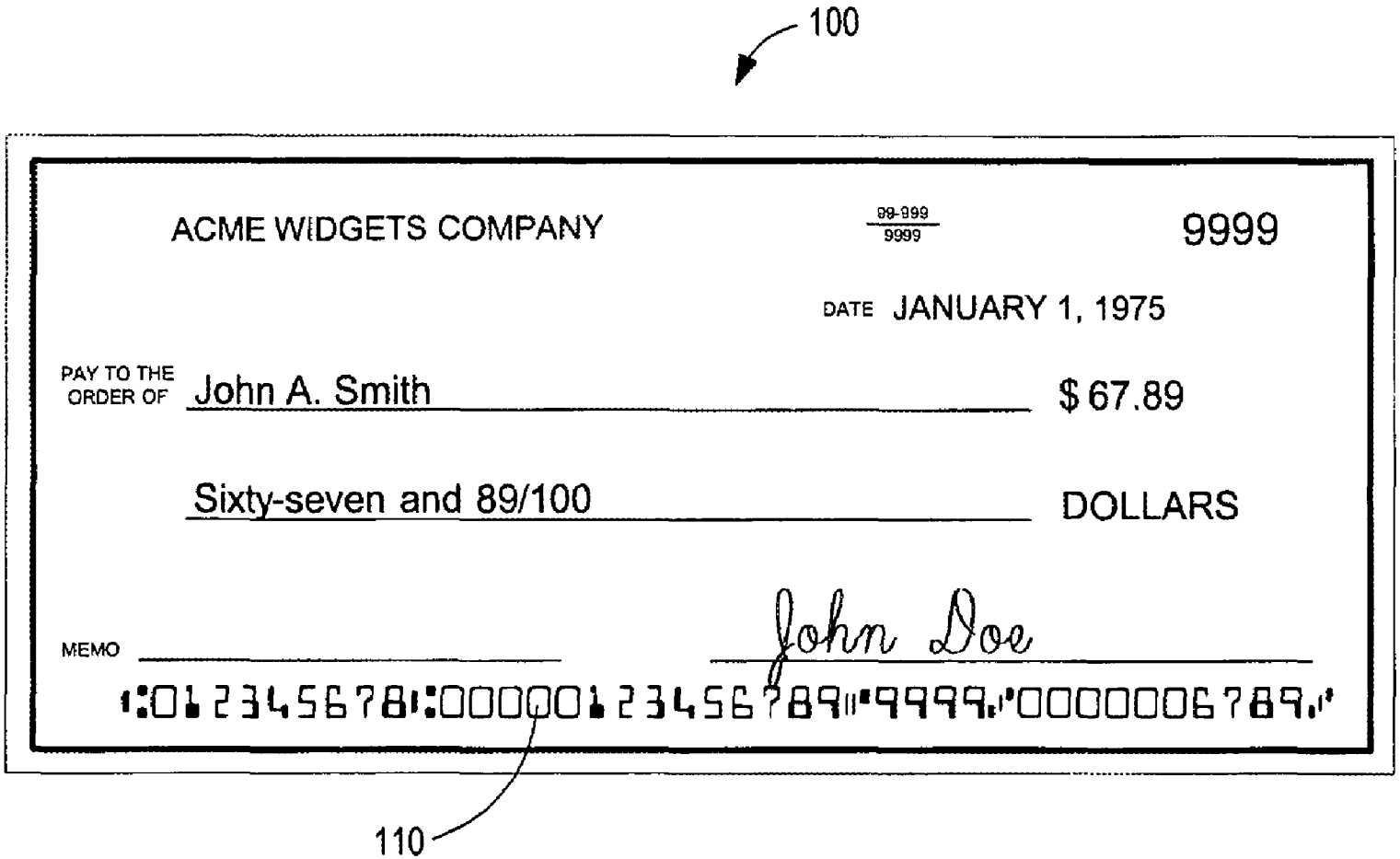
FIG. 1 illustrates a typical bank check, and shows the "bank line" printed in a MICR font.

FIG. 1 depicts an exemplary bank check 100. Near the bottom of the check is a row of characters 110 which is sometimes referred to as the "bank line", printed in a machine-readable "MICR" font. The MICR font design, the location of the bank line, the function of each data field, and the physical properties of the ink or toner used to print the characters are defined in American National Standards Institute (ANSI) and American Banking Association (ABA) specifications; adherence to these specifications allows checks to be routed and processed by automated equipment. The bank line includes, for example, fields identifying the bank or financial institution the check is drawn on, the account number, and the amount of the check. The bank line may be printed in its entirety when the check is prepared, or, as is typically the case with "personal" checks, the amount field may be written later when the check is initially processed.

Among the specified physical properties of the bank line are that the ink or toner used to print the line must have certain magnetic properties, which is typically achieved by the inclusion of a substantial iron oxide content to the ink or toner. The special physical properties of MICR toner, together with the lower demand, account for the significantly greater cost of MICR toner.

Figure 2:
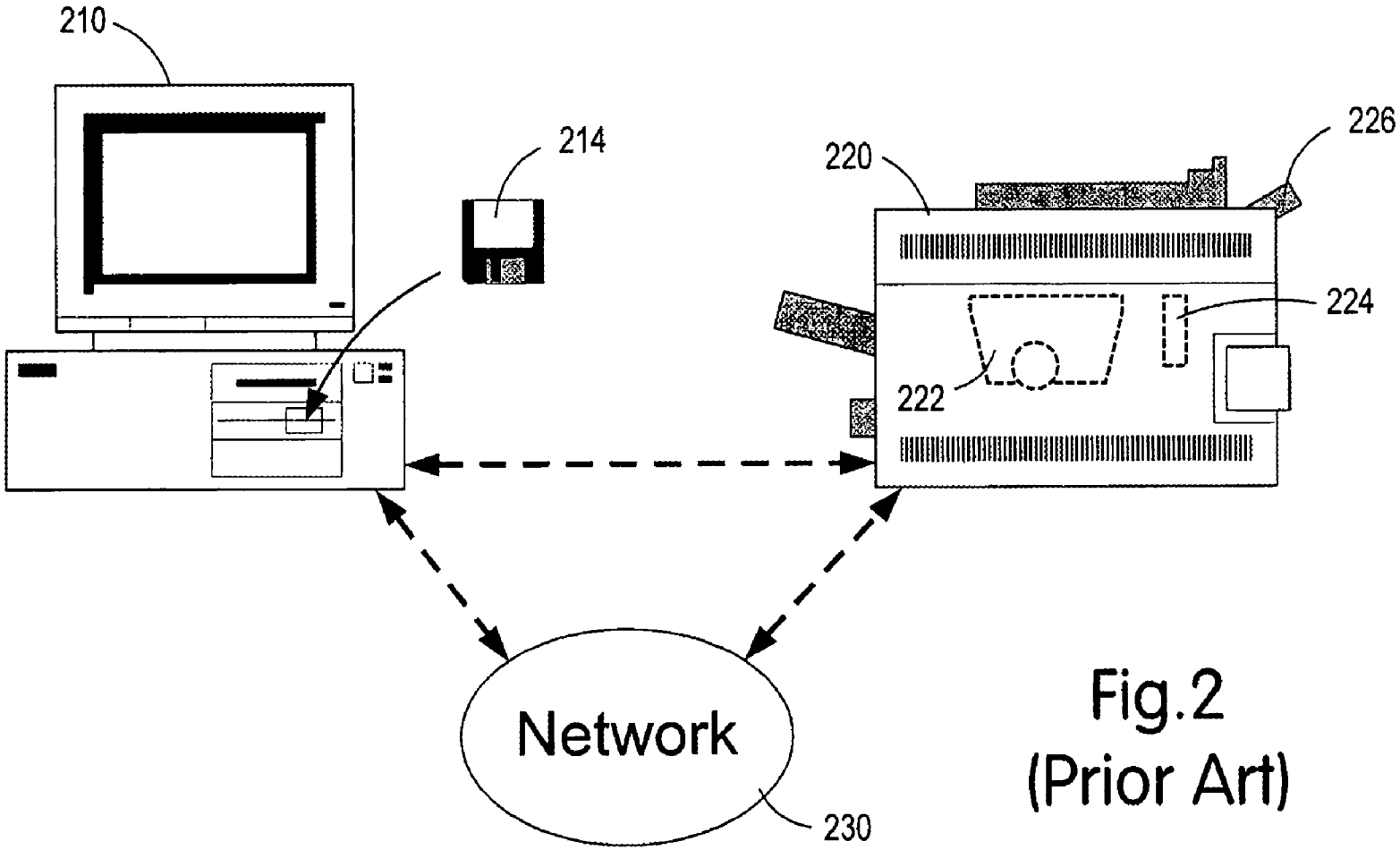
Fig.2 (Prior Art)
FIG. 2 illustrates an exemplary printing system, such that may be utilized by a small business for printing checks.

FIG. 2 illustrates an exemplary prior art printing system, such as may be utilized by a small business for printing checks. The system includes a computer 210, such as a standard personal computer, and a laser printer 220. The printer 220 may be directly connected to the host computer 210, or may connected through a network connection 230, as is known in the art. Although the computer 210 is shown as comprising a stand-alone computer, it is noted that the computer 210 may be but one computer in a computer network. The laser printer 220 internally includes a toner cartridge 222, which has a supply of MICR toner, as explained below. The printer further has a paper supply 226 with suitable check paper. The MICR font required to print MICR characters may typically be provided by a module 224 installed in the printer 220 (such as, for example, a DIMM module, SIMM module, or circuit board), or may be provided by software, such as represented by diskette 214.

Printing system software resident on the host computer 210 includes a collection of applications that are installed on the host computer 210 to allow the host computer 210 to communicate with the laser printer 220 in a language compatible with the laser printer 220, and specialized check printing software. This software also allows the host computer 210 to query the laser printer 220 for status. The system software is usually specific to a computer operating system such as Windows 95/98/2000/NT, Unix, Linux, OS/2, etc. The system software may be composed of several applications, such as a printer driver, a status utility, and administrative utility, etc. The printing system software on the host computer 210 includes, but is not limited to, all printer-related software (multiple applications), a single application, portions of an application (.exe or .dll files), etc.

Prior to printing checks with the prior art system illustrated in FIG. 2, an office worker using would first insure that a toner cartridge containing the requisite MICR toner is installed, and that the requisite MICR font is available. The office worker would then use the specialized check printing software to print the desired checks. To fully secure the system after finishing a check printing session such that other users may not surreptitiously use the check printing capabilities or inadvertently waste MICR toner, the office worker would then remove and secure the MICR toner cartridge.

Figure 3:
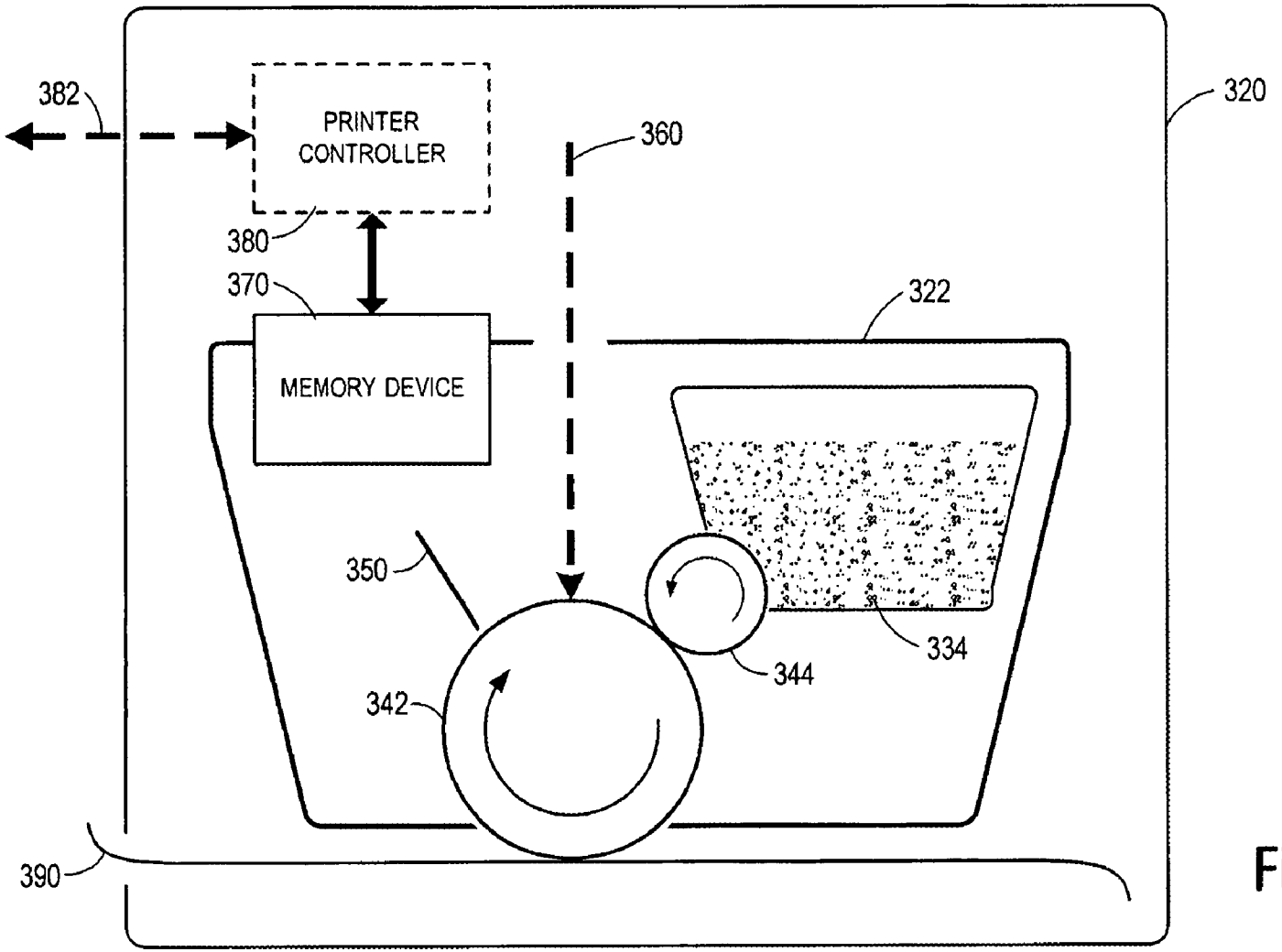
FIG. 3 schematically illustrates an exemplary toner cartridge, such that may include embodiments of the invention.

FIG. 3 depicts in schematic form an exemplary laser printer 320, such as may be utilized with embodiments of the invention. Within the printer 320 is a toner cartridge 322 containing a reservoir 334 of toner (in the present invention, MICR toner). Preferably, cartridge 322 can be easily removed from the printer 320 and replaced when the toner is depleted, or when the operator wishes to secure the cartridge, as explained below.

As shown in FIG. 3, toner cartridge 320 includes toner reservoir 334, cartridge printing components 342, 344, 350, and memory device 370. Reservoir 334 represents generally any compartment for holding and dispensing a consumable such as toner. Cartridge printing components 342, 344, 350 represent hardware capable of being used to help produce a printed image using the toner held in reservoir 334, as explained below. Cartridge printing components 342, 344, 350 can be limited-life components, since they are replaced with the cartridge. Memory device 370 represents generally any memory device or combination of memory devices, which can include Read-Only-Memory (ROM); rewritable, persistent storage apparatus, including flash memory, EEPROM, or battery-backed RAM; magnetic media; or optical magnetic media.

Also in exemplary printer 320 is a printer controller 380 that receives print data and commands from a host device (such as a computer, as shown in FIG. 2) through a data link 382. The printer controller 380 may access data in the memory device 370 of the toner cartridge 322, such as, for example, a stored MICR font or data flag. The printer controller 380 may also return status indications to the host device through the data link 382.

The toner cartridge 320 may typically include a photoconductive drum 342, developer 334, and wiper 350. In operation, a uniform electrostatic charge is placed on photoconductive drum 342 by a charging device (not shown). Light 360 from a laser source (not shown) in the printer is scanned across photoconductive drum 342 in a pattern corresponding to the desired print image. The printed image can include any combination of text and graphics. Where exposed to the light, photoconductive drum 342 is discharged, creating an electrostatic version of the desired print image. Developer 334 transfers charged toner particles from toner reservoir 334 to the photoconductive drum 342. The charged toner particles are repelled by the charged portions of photoconductive drum 342 but adhere to the discharged portions. Media feed mechanisms (not shown) move a sheet of print media 390, such as paper for check printing, past the photoconductive drum 342. As media sheet 390 passes across photoconductive drum 342, toner particles are then transferred from photoconductive drum 342 to the media sheet 390. The toner is permanently affixed to the media sheet by fuser rollers (not illustrated), which thermally fix the transferred toner particles to the media sheet 390. Wiper 350 removes any residual toner particles remaining on photoconductive drum 342.

In an embodiment of the invention, memory device 370 is programmed with information defining the MICR font required for check printing. Thus, when cartridge 322 is absent from the printer 320, the MICR font is not present and check printing is therefore precluded. In practice, precluding check printing may also mean that a message is generated on the display of the office worker's computer, such as computer 210 in FIG. 2, informing the worker that a MICR toner cartridge is not installed in the printer, and therefore checks cannot be printed. The MICR font stored on the memory device 370 of the toner cartridge 322 thus helps prevent the printing of checks with non-MICR toner.

The integral MICR font in the MICR toner cartridge memory device 370 also serves as an addition deterrent to the unauthorized printing of checks, in that the font for check printing is absent when the MICR toner is removed from the printer. Thus, a valid-appearing check (albeit not magnetically readable) could not be printed when the MICR toner cartridge was absent. The integral MICR font also simplifies the check printing system for the user, as there is no additional font cartridge that must be installed in the printer, or font software that must be aquired.

Figure 4:
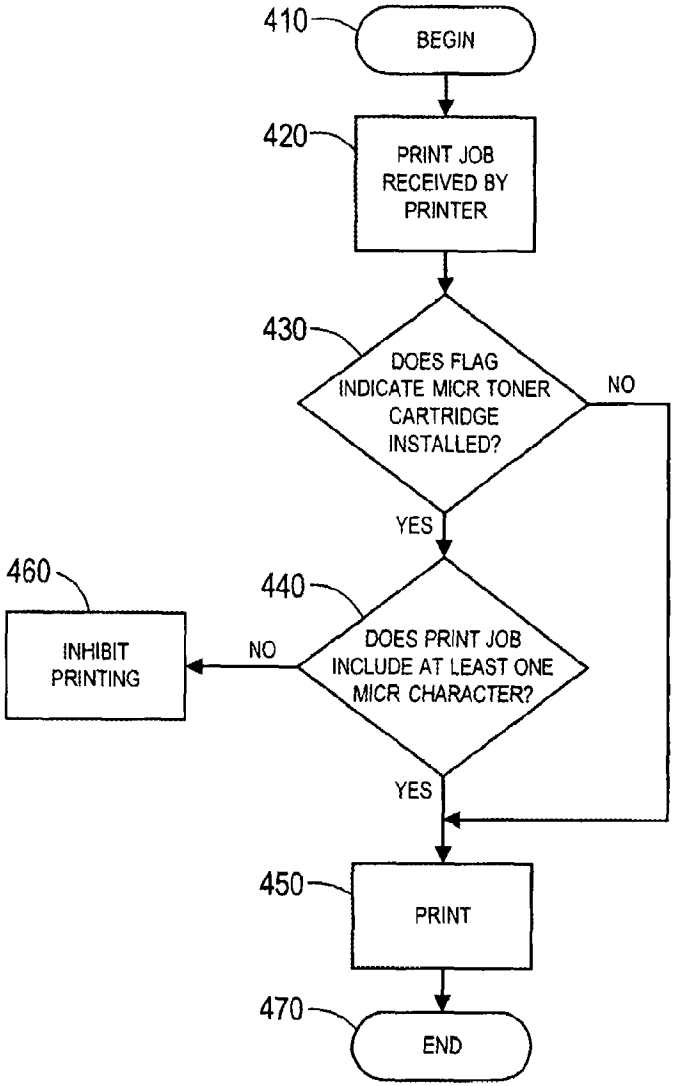
FIG. 4 is a flow diagram illustrating a further embodiment of the invention.

FIG. 4 is a flow chart illustrating the use of a further embodiment of the invention, in which the toner cartridge memory device further contains a flag that indicates that the cartridge contains MICR toner. The flag may be utilized by firmware or software in the printer, or software in the computer controlling the printer, to inhibit printing of non-MICR documents with MICR toner.

As shown in FIG. 4, the use of the flag begins 410 with the receipt of a print job by the printer 420. If firmware within the printer detects that that a MICR toner cartridge is installed 430, the firmware then determines 440 whether the print job contains at least one character utilizing the MICR font. If no MICR characters are contained in the print job, the firmware inhibits printing 460. Inhibiting the print job 460 may involve halting the print job until the office worker performs some action to either correct the situation, such as by replacing the MICR toner cartridge with a non-MICR cartridge, or overrides the situation, such as by directing the printer to complete the print job despite the toner incompatibility. Inhibiting the print job 460 may also include generating a status indication or prompt on a printer display panel (not shown) or computer display, or any other action that prevents the print job from executing without user intervention.

Alternatively to the printer firmware testing the flag and inhibiting printing, software in the computer controlling the print job may monitor the status of the flag and inhibit printing, as described above, when the software detects that a non-MICR document is to be printed with MICR toner.

Alternatively to detecting if at least one character in the MICR font is present in the print job, the printer firmware or computer software may utilize any other mechanism that indicates that MICR characters are to be printed, such as by determining that specific check printing software is running on the host computer.

Figure 5:
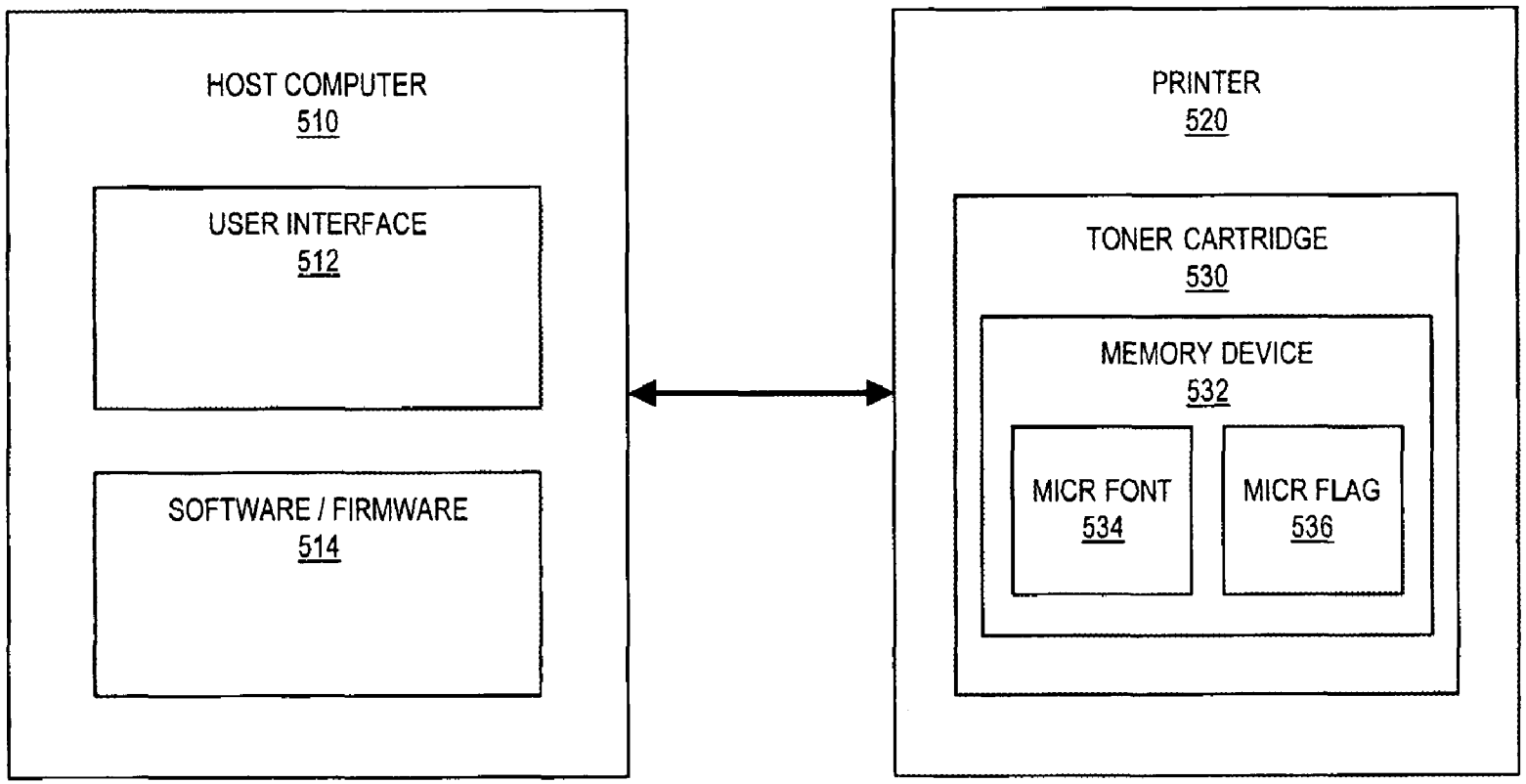
FIG. 5 is a block diagram further illustrating how embodiments of the invention may be incorporated in an exemplary toner cartridge.

FIG. 5 is a block diagram further illustrating how embodiments of the invention may be incorporated in an exemplary toner cartridge. Hierarchically, toner cartridge 530 is installed in printer 520; memory device 532 is integral with the toner cartridge. The memory device 532 may in one embodiment of the invention contain the required MICR font 534 for check printing; in a further embodiment, the memory device may contain a data flag 536 indicating that that the cartridge 532 contains MICR toner.

The printer 520 is typically controlled by a host computer 510, which includes a user interface 512 for displaying information to the user and receiving commands from the user, and software/firmware 514, such as check printing software and a printer driver.

While described with respect to toner cartridges for laser printers, the invention may also be practiced with other types of printers utilizing other forms of MICR marking materials, such as liquid ink.

While the present invention has been particularly shown and described with reference to the foregoing exemplary and alternative embodiments, those skilled in the art will understand that many variations may be made therein without departing from the spirit and scope of the invention as defined in the following claims. This description of the invention should be understood to include all novel and non-obvious combinations of elements described herein, and claims may be presented in this or a later application to any novel and non-obvious combination of these elements. The foregoing embodiments are illustrative, and no single feature or element is essential to all possible combinations that may be claimed in this or a later application. Where the claims recite "a" or "a first" element of the equivalent thereof, such claims should be understood to include incorporation of one or more such elements, neither requiring nor excluding two or more such elements.

What is claimed is:

1. A printer toner cartridge for the printing of Magnetic Ink Character Recognition (MICR) characters, comprising:
- a reservoir for holding a supply of MICR toner; and
- a memory device integral with the toner cartridge, the memory device programmed with information defining a font for printing MICR characters.

2. The printer toner cartridge of claim 1, wherein the reservoir for holding a supply of MICR toner contains a supply of MICR toner.

3. The printer toner cartridge of claim 1, wherein the memory device integral with the toner cartridge comprises an electronic memory.

4. The printer toner cartridge of claim 3, wherein the memory device integral with the toner cartridge comprises a Read-Only-Memory (ROM).

5. The printer toner cartridge of claim 3, wherein the memory device integral with the toner cartridge comprises an Electrically Erasable Programmable Read-Only Memory (EEPROM).

6. The printer toner cartridge of claim 3, wherein the memory device integral with the toner cartridge comprises a flash memory.

7. The printer toner cartridge of claim 3, wherein the memory device integral with the toner cartridge comprises a battery backed Random Access Memory (RAM).

8. The printer toner cartridge of claim 1, wherein the memory device integral with the toner cartridge further includes a data flag indicating that the toner cartridge contains MICR toner.

9. A printer toner cartridge for the printing of Magnetic Ink Character Recognition (MICR) characters, comprising:
- a reservoir for holding a supply of MICR toner;
- a memory device integral with the toner cartridge, the memory device programmed with a data flag indicating that the toner cartridge contains MICR toner;
- and wherein the memory device integral with the toner cartridge further includes information defining a font for printing MICR characters.

10. A printer toner cartridge for the printing of Magnetic Ink Character Recognition (MICR) characters, comprising:
- a reservoir for holding a supply of MICR toner; and
- a memory device integral with the toner cartridge, the memory device programmed with
  - a) information defining a font for printing MICR characters; and
  - b) a data flag indicating that the toner cartridge contains MICR toner.

11. The printer toner cartridge of claim 10, wherein the reservoir for holding a supply of MICR toner contains a supply of MICR toner.

12. The printer toner cartridge of claim 10, wherein the memory device integral with the toner cartridge comprises an electronic memory.

13. The printer toner cartridge of claim 12, wherein the memory device integral with the toner cartridge comprises a Read-Only-Memory (ROM).

14. The printer toner cartridge of claim 12, wherein the memory device integral with the toner cartridge comprises an Electrically Erasable Programmable Read-Only Memory (EEPROM).

15. The printer toner cartridge of claim 12, wherein the memory device integral with the toner cartridge comprises a flash memory.

16. The printer toner cartridge of claim 12, wherein the memory device integral with the toner cartridge comprises a battery backed Random Access Memory (RAM).

17. A method of controlling the printing of bank checks, the checks including Magnetic Ink Character Recognition (MICR) characters, the method comprising:

providing within a single removable cartridge a supply of MICR marking material and a memory device containing a MICR font; and retrieving the MICR font from the memory device when printing checks.

* * * * *